US005409439A

United States Patent [19]

Lee

[11] Patent Number: 5,409,439

[45] Date of Patent: Apr. 25, 1995

[54] EXERCISE APPARATUS FOR DEVELOPMENT OF ARM AND LEG MUSCLES

[76] Inventor: Sunny Lee, No. 318 8th Flr, Fu Shbng Rd, Sec, 3, Tai Chung, Taiwan, Prov. of China

[21] Appl. No.: 193,406

[22] Filed: Feb. 7, 1994

[51] Int. Cl.[6] ..... A63B 21/04

[52] U.S. Cl. ..... 482/130; 482/907; 482/138; 482/134; 482/133

[58] Field of Search ..... 482/129, 130, 135, 136, 482/133, 134, 907, 138; 601/34, 35

[56] References Cited

U.S. PATENT DOCUMENTS 4,204,676 5/1980 Givens ..... 482/130

4,621,620 11/1986 Anderson ..... 601/34

4,829,612 5/1989 Adams ..... 482/147

5,215,511 6/1993 Cheng ..... 482/133

*Primary Examiner*—Richard J. Apley

*Assistant Examiner*—Lynne A. Reichard

[57] ABSTRACT

An exercise apparatus comprises a base and a transmission device. The base is provided with a plurality of support frames, one of which is provided with two locking shafts. The transmission device is mounted pivotally on the base and composed of movable support, transmission support, adjustment support, rest pad, leg pad, and elastic element. The user of the apparatus is capable of doing exercise for building the muscles of arms and legs.

1 Claim, 6 Drawing Sheets

EXERCISE APPARATUS FOR DEVELOPMENT OF ARM AND LEG MUSCLES

BACKGROUND OF THE INVENTION

The present invention relates generally to a gymnastic apparatus, and more particularly to an exercise apparatus for developing arm and leg muscles.

As people in the modern society are increasingly preoccupied with their jobs and various life activities, they are less able to allocate time for doing an outdoor exercise. As a result, an indoor gymnastics has become popular than ever. There are a great variety of gymnastic apparatus available in the market today. As far as the exercise apparatus for developing arm and leg muscles are concerned, they are generally provided with weights. Such conventional muscle building apparatus are in fact so cumbersome that they cannot be made economically. In addition, such cumbersome exercise apparatus are not suitable for use in a private home in which an adequate space for accommodating such a cumbersome exercise apparatus of the prior art is often hard to come by.

SUMMARY OF THE INVENTION

It is, therefore, the primary objective of the present invention to provide an exercise apparatus for developing arm and leg muscles, which is suitable for use in a private home without taking up too much of the home space available, which is effective in helping the users to build their arm and leg muscles, and which can be made economically.

In keeping with the principle of the present invention, the foregoing objective of the present invention is attained by the exercise apparatus comprising mainly a base and a transmission device. The base is provided with a plurality of support frames, one of which is provided thereon with two locking shafts. The transmission device is mounted pivotally on the base and composed of movable supports, transmission supports, adjustment supports, rest pads, leg pads, and an elastic element. The user of the apparatus is capable of doing a muscle building exercise by compressing and stretching in both the inside and the outside of the rest pads, which are caused to return to their original positions by the elastic element.

The foregoing objective, features and functions of the present invention can be more readily understood by studying the following detailed description of a preferred embodiment of the invention in conjunction with the drawings provided herewith.

DETAILED DESCRIPTION OF THE INVENTION

Figure 1:
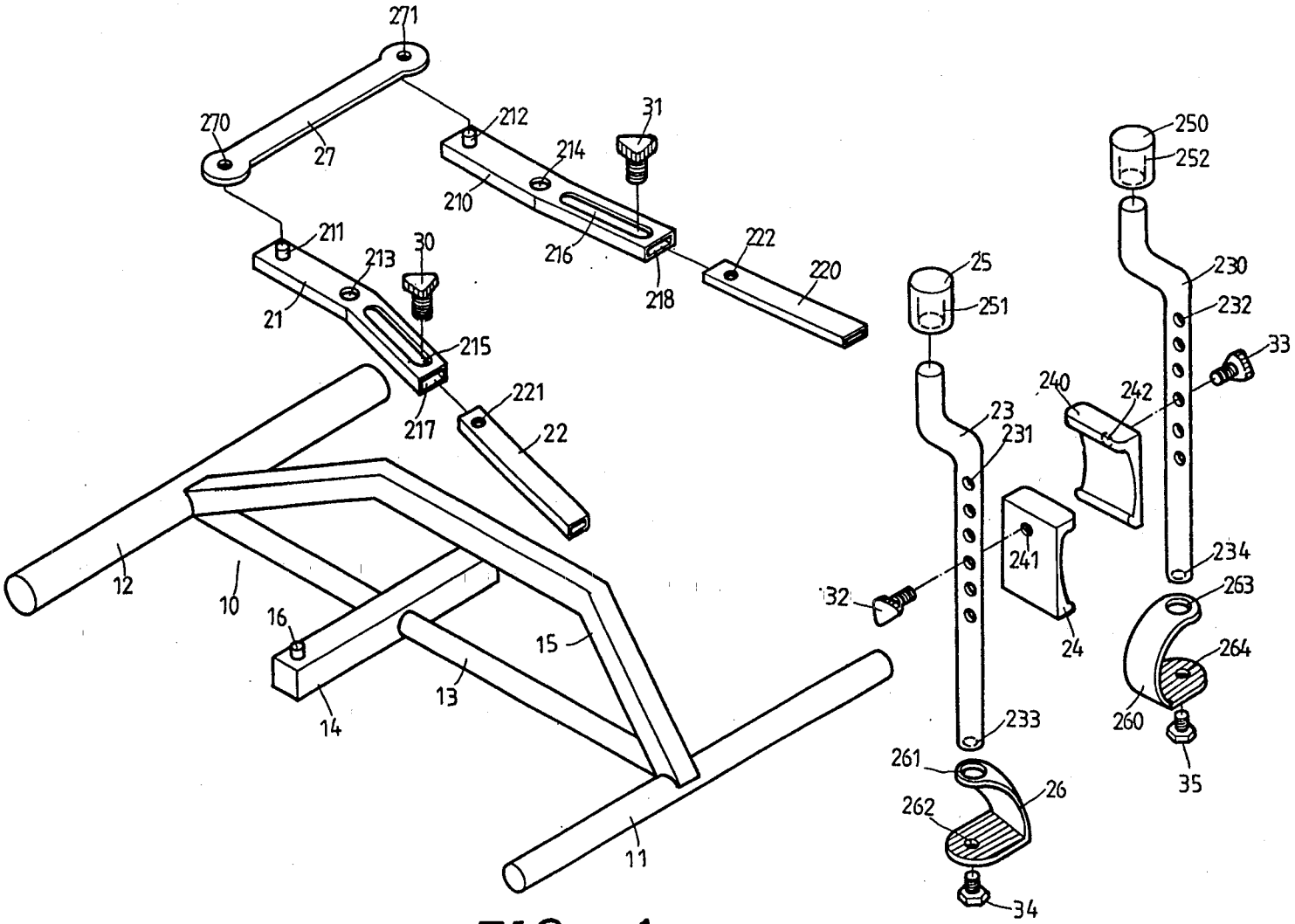
FIG. 1 shows an exploded view of an exorcise apparatus for developing arm and leg muscles of the present invention.

Referring to FIG. 1, an exercise apparatus embodied in the present invention is shown to comprise mainly a base 10 and a transmission device 20.

The base 10 is provided with a predetermined number of supporting frames 11, 12, 13 and 14, and an arch support 15. The supporting frame 14 is provided on the top thereof with two locking shafts 16 and 17.

The transmission device 20 is composed of two movable supports 21, 210, two adjustment supports 22, 220, two transmission supports 23, 230, rest pads 24, 240, 25, 250, two leg pads 26, 260, and an elastic element 27. The movable supports 21, 210 are provided with fixing shafts 211 and 212, through holes 213 and 214, elongate holes 215 and 216, and guide slots 217 and 218. The adjustment supports 22, 220 are inserted into the guide slots 217 and 218 of the movable supports 21, 210. The adjustment supports 22, 220 are provided with threaded holes 221 and 222. The transmission supports 23, 230 are pivoted to the adjustment supports 22, 220. The transmission supports 23, 230 are provided with through holes 231 and 232. The transmission supports 23 and 230 are provided at one end thereof with threaded holes 233 and 234. The rest pads 24, 240 are provided in the back thereof with threaded holes 241 and 242 while the rest pads 25, 250 are provided with fitting holes 251 and 252. The rest pads 24, 240 and 25, 250 are located on the transmission supports 23, 230. The leg pads 26, 260 are pivoted to the bottom end of the transmission supports 23, 230. The leg pads 26, 260 are provided in the top end thereof with through holes 261, 262, 263 and 264. The elastic element 27 is pivoted to the fixing shafts 211 and 212 of the movable supports 21, 210 or the base 10 in accordance with the method of use of the exercise apparatus. The elastic element 27 of a predetermined elasticity is provided at both ends thereof with through holes 270 and 271.

Figure 2:
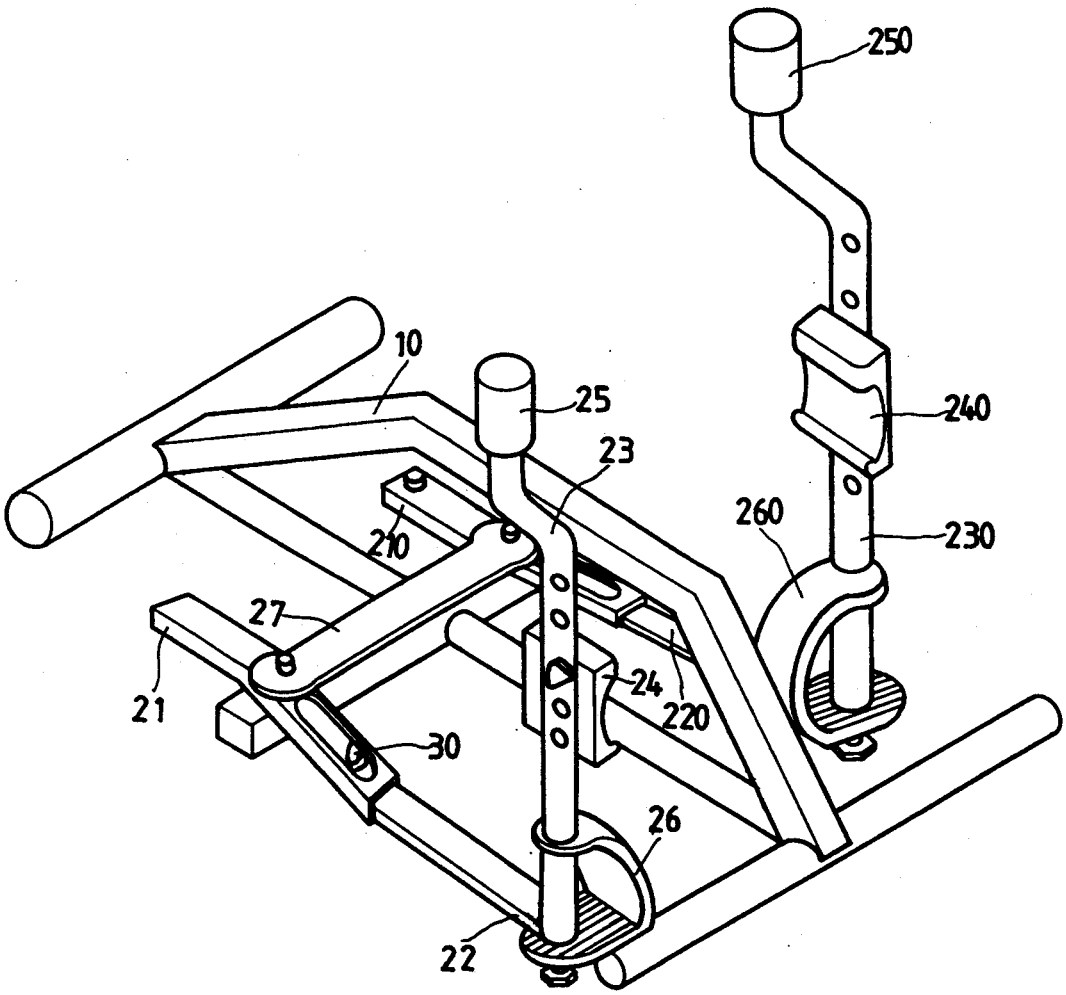
FIG. 2 shows a perspective view of the exercise apparatus in combination, according to the present invention as shown in FIG. 1.

In combination as shown in FIG. 2, the movable supports 21, 210 are inserted along the locking shafts 16 and 17 of the support frame 14. The adjustment supports 22, 220 are located at a predetermined position in accordance with the length of the legs of a user. The adjustment supports 22, 220 are then fastened by means of adjusting screws 30 and 31. The rest pads 24, 240 are located by means of adjusting screws 32 and 33. The leg pads 26, 260 are fastened to the transmission supports 23, 230 by means of screws 34 and 35.

Figure 3:
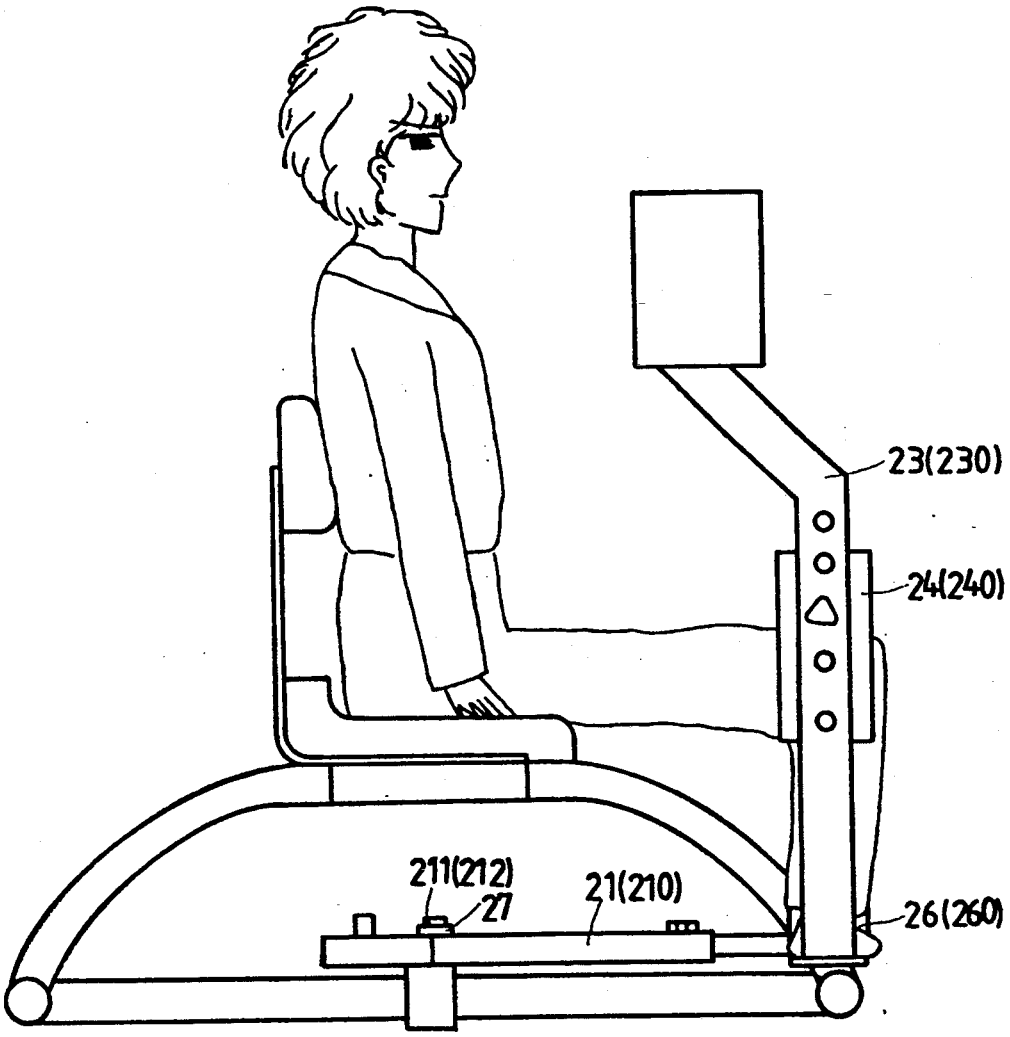
FIG. 3 shows a schematic view of the exercise apparatus in action, according to the present invention.
Figure 4:
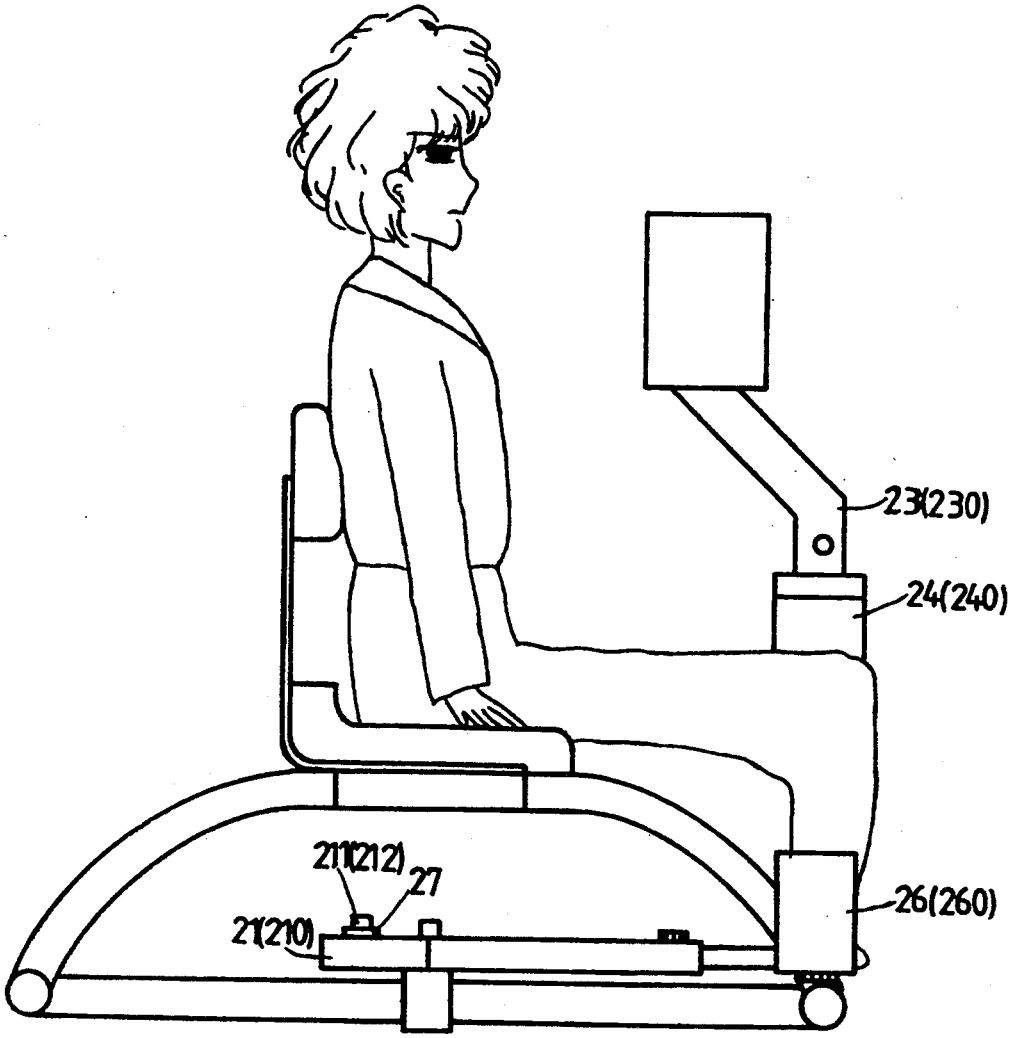
FIG. 4 shows another schematic view of the exercise apparatus in action, according to the present invention.
Figure 5:
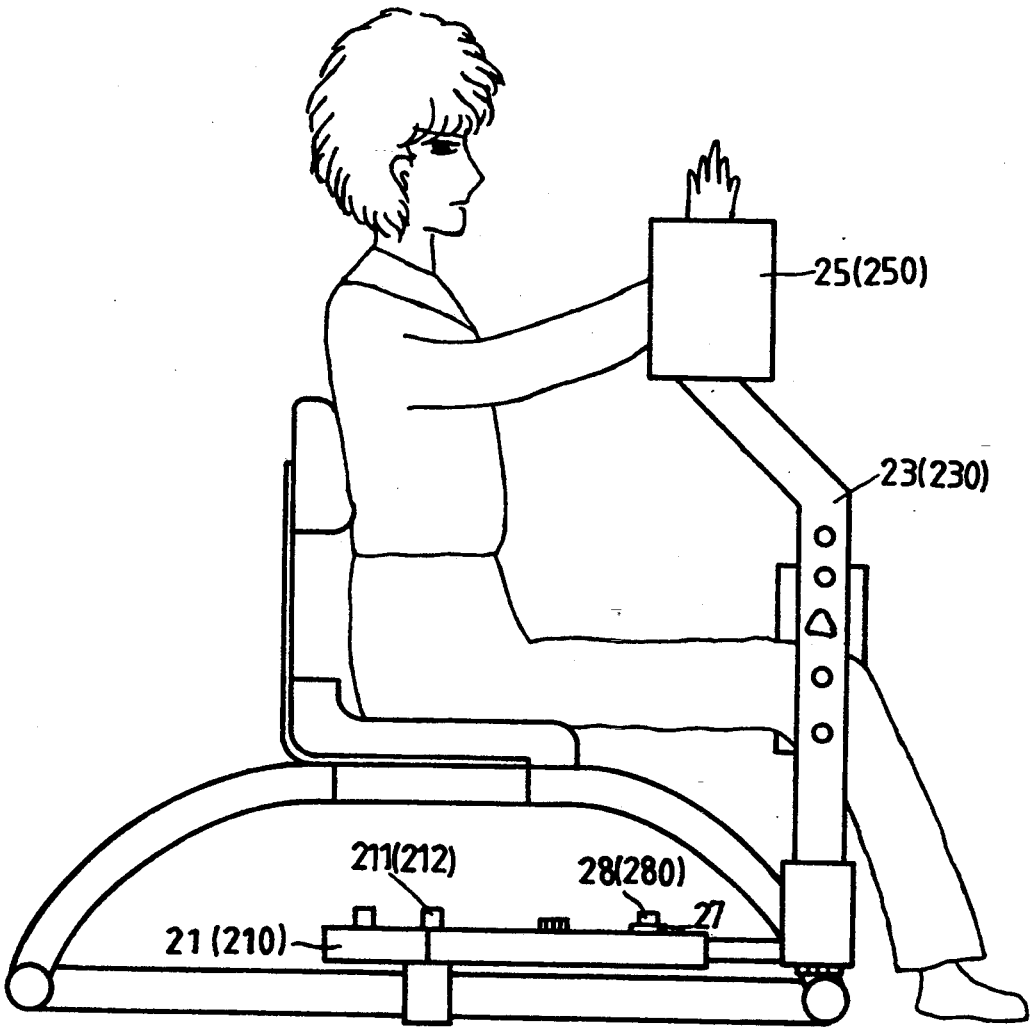
FIG. 5 is another schematic view showing that the exercise apparatus of the present invention is at work.
Figure 6:
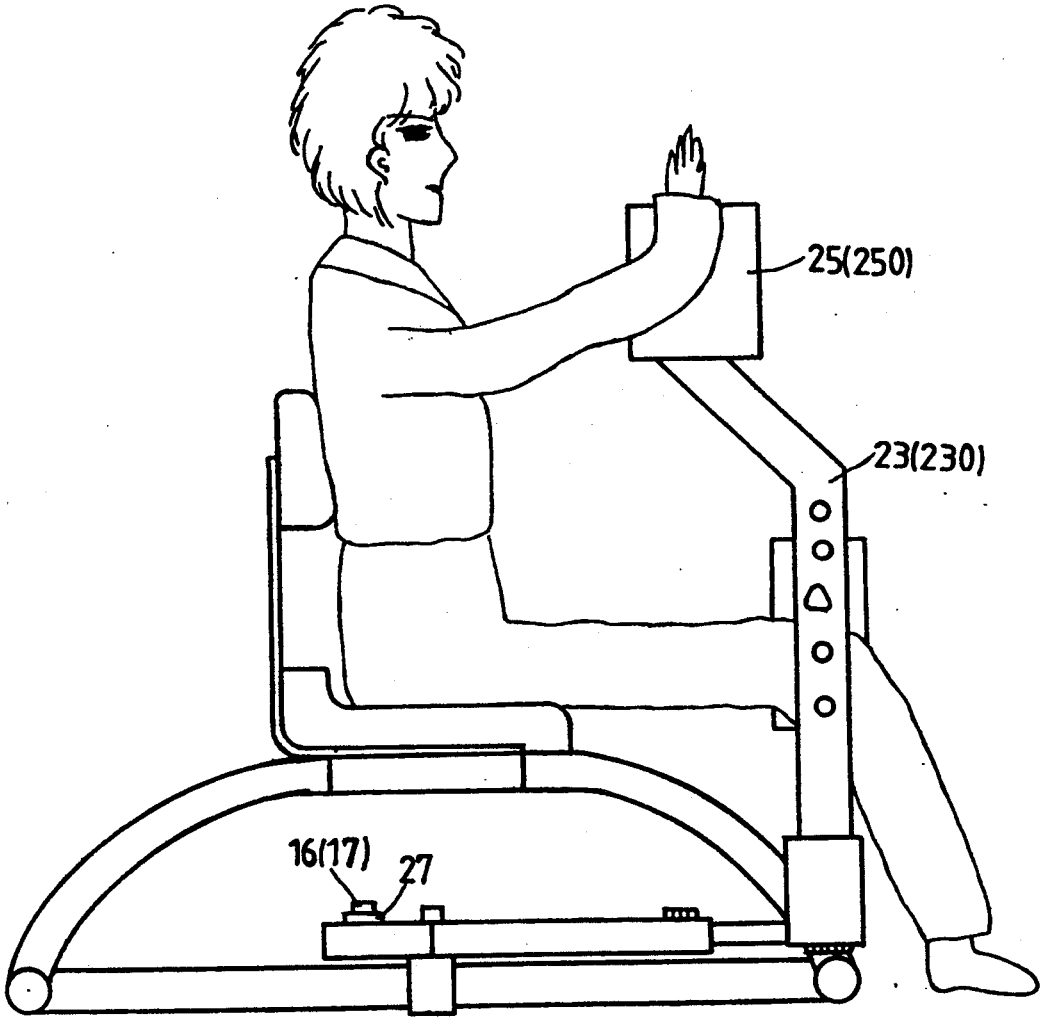
FIG. 6 is still another schematic view showing that the exercise apparatus of the present invention is in action.

As shown in FIG. 3, a user sits on a chair which is beyond the scope of the present invention and will not be described here. The soles of the user are placed on the leg pads 26, 260 while the knee sides are rested on the rest pads 24, 240. Upon being exerted on by a force of the user's legs, the movable supports 21, 210 are caused to stretch the elastic element 27. As the force of the user's legs is removed, the elastic force of the elastic element 27 causes the rest pads 24, 240 to return to its original position. Now referring to FIG. 4, the leg pads 26, 260 and the rest pads 24, 240 are shown to be caused to move outwards. The elastic element 27 can be fitted over the fixing shafts 211 and 212 of the movable supports 21, 210. Upon being exerted on by a force of the user's legs, the movable supports 21, 210 are caused to stretch the elastic element 27. As the force of the user's legs is removed, the rest pads 24, 240 of the transmission supports 23, 230 are caused to return to its original position by the elastic force of the elastic element 27. As shown in FIG. 5, the exercise apparatus of the present invention may be used to build the muscles of a person's arm by placing the arm against the inner side of the rest pads 25, 250. The elastic element 27 is fitted over the locking shafts 16, 17 of the support frame 14 of the base 10. As the exerciser moves outwards his or her elbow, the transmission supports 21, 210 are caused to stretch the elastic element 27. As the force of the elbow is removed, the rest pads 25, 250 of the transmission supports 23, 230 are caused to return to its original position by the elastic force of the elastic element 27. The exerciser may place his or her arm against the outer side of the rest pads 25, 250 while the elastic element 27 is fitted over the fixing shafts 211, 212 of the movable supports 21, 210, as shown in FIG. 6, for building the muscles of arm by compressing the apparatus.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. An exercise apparatus for development of arm and leg muscles comprising:

a base provided with an arch support and a predetermined number of support frames on which said arch support is mounted; and a transmission device comprising two movable supports provided respectively with a guide slot and mounted on one of said support frames of said base, two adjustment supports fastened respectively with said movable supports, two transmission supports pivoted respectively to said adjustment supports, four rest pads fastened respectively to said transmission supports, two leg pads pivoted respectively to bottom ends of said transmission supports, and an elastic element mounted on said two movable supports of said base;

wherein said two adjustment supports can be adjusted respectively in length according to the length of a user's legs by sliding said two adjustment supports respectively inside said guide slot of said two movable support;

wherein said elastic element is caused to stretch by said two movable supports when said leg pads and said rest pads are forced to move outwards in opposite directions by a user's legs; and wherein said elastic element is caused to stretch by said two transmission supports when said rest pads are forced to move outwards in opposite directions by a user's arms.

* * * * *